US005095837A

United States Patent [19]

Baird

[11] Patent Number: 5,095,837

[45] Date of Patent: Mar. 17, 1992

[54] RAM-AIR INFLATABLE BEAM FOR USE WITH A SPINNAKER

[76] Inventor: Lincoln F. Baird, 3482 Moore St., Los Angeles, Calif. 90066

[21] Appl. No.: 590,144

[22] Filed: Sep. 28, 1990

[51] Int. Cl.[5] ..... B63H 9/04

[52] U.S. Cl. ..... 114/103

[58] Field of Search ..... 114/102, 103, 106, 39.1; 244/245, 246

[56] References Cited

U.S. PATENT DOCUMENTS 3,391,668 7/1968 Birchill ..... 114/103
4,296,704 10/1981 Bridge ..... 114/103

FOREIGN PATENT DOCUMENTS 2030945 4/1980 United Kingdom ..... 114/103

*Primary Examiner*—Jesus D. Sotelo
*Attorney, Agent, or Firm*—W. Edward Johansen

[57] ABSTRACT

A spinnaker, a large, substantially triangular sheet of flexible material with a front face and two side peripheral edges, is attached to a mast of a sail boat. A ram-air inflatable beam for use with the spinnaker includes a tube, an air inlet and a valve. The tube is formed by a rectangular sheet of flexible material which has a first end edge, a second end edge and two side edges. The two side edges are disposed perpendicular to the mast and are mechanically coupled to the front face of the spinnaker extending from one side peripheral edge to the other side peripheral edge thereof to form a first open end and a second open end. The air inlet includes a stiffening member and an extended scoop which are mechanically coupled to the tube at the first open end and lets air into the tube. The valve includes a loose flap of cloth and an anchor. The loose flap of cloth has a first end, which is attached to the interior of the tube at the second open end, and a second end, which the anchor mechanically couples to the spinnaker so that a section of the loose flap of cloth closes off the second open end of the tube in order to trap air therein.

7 Claims, 4 Drawing Sheets

Fig. 8.
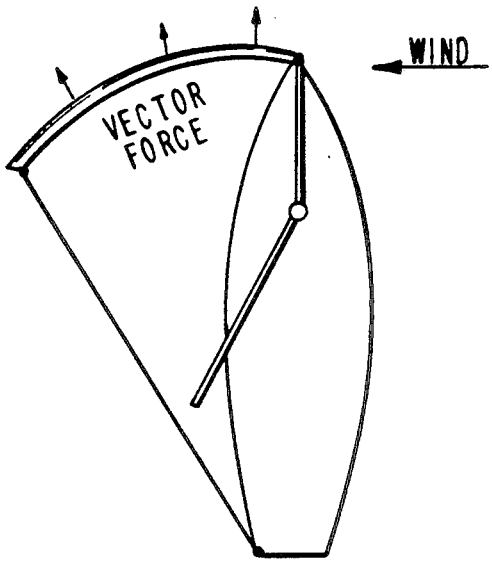
Fig. 9.
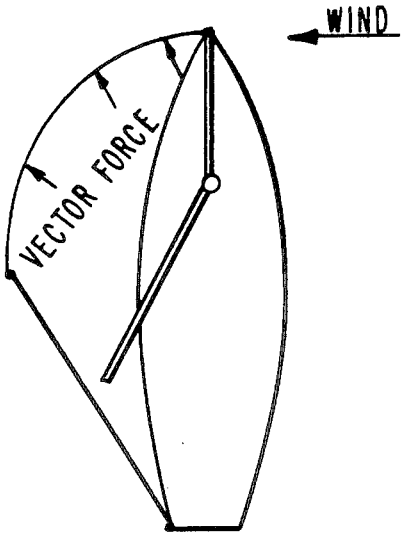
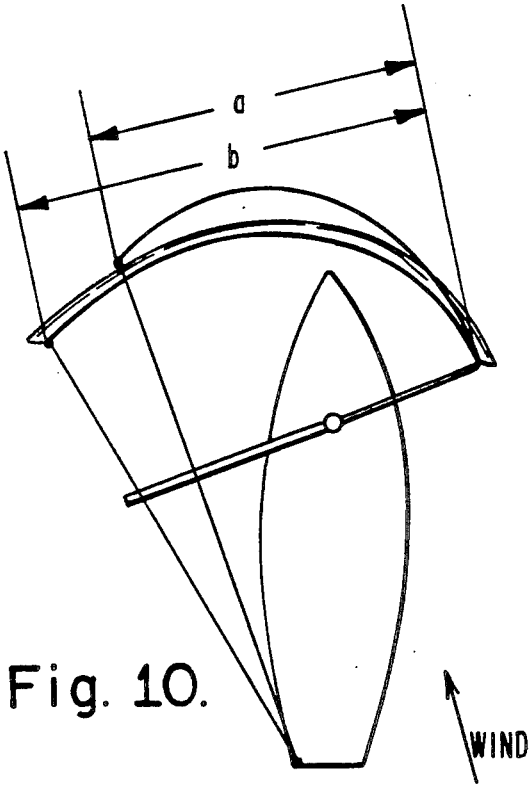
Fig. 10.
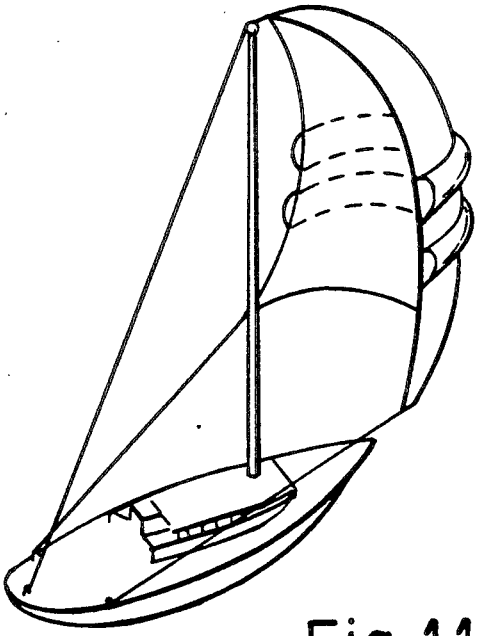
Fig. 11.

RAM-AIR INFLATABLE BEAM FOR USE WITH A SPINNAKER

BACKGROUND OF THE INVENTION

1. Field of the Inventions

The present invention relates to spinnakers and more particularly to a ram-air inflatable beam for use with a spinnaker.

2. Description of the Prior Art

When sailing before the wind or when the wind is abaft the beam, it is often desirable to carry a large triangular sail known as a spinnaker from the foremast. This sail requires a pole which extends from the mast to one corner of the sail, called the tack, from control. On medium size and larger boats, spinnaker pole handling requires considerable skill, effort and precision on the part of the crew and can present certain risks and difficulty, for the pole may be quite long and heavy, making it awkward to handle. The pole is customarily stored on deck, clipped into fittings provided, or otherwise lashed down. As a boat approaches a situation where it is desired to carry a spinnaker, the pole must be released from its storage place, handled in an unsupported condition on what may be a pitching deck, and positioned, so one end can be fastened to the other end of the pole and adjusted to hold the pole in its proper position.

With the spinnaker set and drawing, it is often necessary to alter course to cross the wind, requiring a jibe, which maneuver necessitates that the spinnaker pole be shifted from one corner of the sail to another. In the past, jibing of the spinnaker has been accomplished one of several ways, all of which require skill, physical dexterity, and involve a certain amount of risk. One method of jibing the spinnaker is to remove the end of the pole fastened to the mast from same and clip that end to the free corner of the sail, then to remove the end of the pole which is fastened to the sail from same and move that end of the pole back where it can be fastened to the fitting on the mast. Although, during the maneuver just described, the weight of the pole may be supported by a topping lift, when the pole is off the mast, it can swing violently and can present problems in manipulation. Further, in a fresh breeze it is often difficult to refasten the pole to the mast against existing pressures and there is the additional hazard removing the pole from the mast against the same forces. Another way to jibe a spinnaker is to raise the mast end of the pole up to mast track for a sufficient distance to make it possible to pass the forward end of the pole through the triangle formed by the forestay, the deck and the mast, and then sequentially to lower the end of the pole fastened to the tack of the sail by releasing the topping lift, then release the tack of the sail from the pole, then pass the pole to the free corner (clew) of the spinnaker, then fasten the pole to the new corner, and then to reset the pole by readjusting the topping lift and sliding the pole back down the mast track. While this latter method provides better pole control, it requires considerable skill and timing and, if not performed smoothly, can result in a spinnaker wrapped around a stay. Further, when it is decided to remove the spinnaker, the tack of the sail must first be released from the pole which is often difficult due to the length of the pole, and before the boat is again fully maneuverable, the pole must be released from the mast and returned to its storage position on the deck, and finally all the lines used must be straightened out so they will not foul with the working lines of the new sail plan.

U.S. Pat. No. 4,879,961, entitled Sail Airfoil Device, issued to Angel R. Aguilera on Nov. 14, 1989, teaches an airfoil device includes an inflatable structure for attachment to an existing sail to form a sail assembly. The inflatable structure is dimensioned and arranged to extend over a substantial portion of the existing sail and a valve arrangement is included for enabling a user to inflate and deflate the inflatable structure while it is so attached to thereby vary the sail assembly shape. The inflatable structure includes inner and outer layers that define an enclosed interior suitable to contain a pressurized gas for inflation purposes, and they are dimensioned and arranged to provide an airfoil shape to the sail assembly when the inflatable structure is inflated. The inflatable structure may be arranged to be either removably or fixedly attached, and various configurations are disclosed to enable use with various types of sails for all points of sailing under various wind conditions.

U.S. Pat. No. 4,296,704, entitled Anti-gravity Spinnaker, issued to John G. Bridge on Oct. 27, 1981, teaches an improved spinnaker which is lighter-than-air and designed to float ahead of the boat and to retain its shape when subject to wind variations. In sailing a sailboat with the wind behind, it is often desirable to use a spinnaker. A spinnaker is a large light weight sail which is deployed in front of the jib and the mainsail. It helps to capture the wind and propel the boat forward in the water. Although helpful, these large sails present numerous problems to the sailor. A spinnaker is normally attached directly to the mast of the sailboat and requires both a boom and a guy. Because of the need for a boom, the size of the spinnaker is usually limited. When the wind dies, a conventional spinnaker is likely to collapse and in doing so, its large size makes it awkward to handle. Because of its large size and light weight it is relatively fragile and if hit by a sudden gust of wind it may rip and shred under the sudden tension. In rough sea a conventional spinnaker often loses the air it has captured and collapses because of the constant rocking of the boat in heavy waves. The lighter-than-air spinnaker is designed to float ahead of the jib, the mainsail, and if used, the conventional spinnaker. The lighter-than-air spinnaker is attached to the hull of the boat on the edge of the hull and to the top of the mast by starboard rigging, port rigging and top rigging, respectively. The lighter-than-air spinnaker is held aloft by inflatable bags attached to the exterior surface of the spinnaker. The triangular shaped spinnaker includes a piece of flexible sail fabric having a top end, a bottom end, two sides, and exterior and two interior surfaces, respectively. The inflatable bags are generally tubular in construction and are attached to the exterior surface so that the sides of the bags are parallel to the top end and the bottom end of the sail fabric. Preferably, the bags attached near the top end of the fabric are wider than those attached near the bottom end of the fabric. This gives greater buoyancy to the upper part of the sail and tends to maintain the sail in an upright position. The bags may contain any suitable lighter-than-air gas, such as hydrogen, helium, heated air or mixtures thereof. The interiors of the bags are preferably interconnected by connecting tubes or the like for the purpose of equalizing the pressure in all of the bags.

U.S. Pat. No. 3,464,379, entitled Spinnaker Pole, issued to John B. Lawson Sept. 2, 1969, teaches a sailing craft which has a deck, mast and forestay is provided with a spinnaker pole which may be shortened telescopically or by folding. Mechanical and hydraulic devices control extension and contraction.

U.S. Pat. No. 3,851,612, entitled Spinnaker Construction, issued to Domina C. Jalbert on Dec. 3, 1974, teaches a spinnaker which is formed having an upper region of a desired compound curvature formed by known means and a lower region, where the curvature is substantially in a horizontal plane only, formed of a plurality of flat panels and aerodynamic cells or panels. Each aerodynamic cell is formed having a built-in pocket with sides having a straight edge and a cambered edge extending therefrom with the cambered edges being connected by a rectangular piece of sail cloth. A cross section through said built-in pocket, taken through the length of the rectangular piece of sail cloth, forms an airfoil contour. An aerodynamic sail construction of a spinnaker is shown in U.S. Pat. No. 3,356,059. Various spinnaker designs have been described in U.S. Pat. Nos. 3,174,453, 3,720,180 and 3,851,612.

U.S. Pat. No. 4,706,593, entitled Swiveling Wind Scoop, issued to Philip G. Vail, Jr. on Nov. 17, 1987, teaches a wind scoop for ventilating the enclosed interior of a boat through a hatch opening thereof which includes a flexible sail for continuously directing an air flow into the hatch opening independent of the direction of the boat with respect the wind, a mast for rotatably supporting the sail above the hatch opening, and fasteners for holding the mast to the boat above the hatch opening. A wing mechanism responsive to changes in the direction of the wind for changing the orientation of the sail and a swivel mechanism for rotating the sail on the mast are also disclosed. An auxiliary scoop for mounting within the boat to further direct air flow within the boat, and a rain cover for mounting above the wind scoop may be provided.

U.S. Pat. No. 4,434,740, entitled Wind-scoop for Small Boats, issued to John M. Childs on Mar. 6, 1984, teaches a wind-scoop for small boats which has a collapsible work of resilient bent wire members, over which a dome-shaped fabric cover member is received in form fitting relation, one side only of which cover member is air permeable for scooping wind to be directed below deck. The bent wire members of the framework, at their lower ends, are provided with radially outwardly-directed hook means for releasable attachment with respect to the peripheral edge of a deck through opening.

U.S. Pat. No. 4,164,193, entitled Adjustable Spinnaker Header and Rig Therefor, issued to Milton B. Smith on Aug. 14, 1979, teaches a spinnaker header and rig which is adapted to high performance racing sailboats for adjusting the height from which the spinnaker is flown, characterized by gear adjustable as to height along the forestay under control of a halyard and downhaul, and by a backhaul to take the driving force of the spinnaker.

U.S. Pat. No. 4,473,021, entitled Spinnaker Boom, issued to Mikael Aronowitsch and Karl Lyth on Sept. 25, 1984, teaches a spinnaker boom which is hingedly attached to the mast of a sailing boat by a traveller. The traveller is movable along the boom so that the boom can be moved relative to the mast substantially transversely to the longitudinal direction of the boat.

U.S. Pat. No. 4,865,272, entitled High Camber Ram-Air Parachute, issued to Ray P. Schwartz on Sept. 12, 1989, teaches a gliding parachute of the rain-air type which has aligned upper and lower panels separated by high camber airfoil shaped ribs whose maximum camber thickness is equal to or less than ten percent of its cord length and so constructed so as to impart a recessed air pocket under its lower panel.

U.S. Pat. No. 4,652,173, entitled Self-inflating Oil Spill Boom, issued to John Kallestad on Mar. 24, 1987, teaches a collapsible boom for use in confining oil spills on water formed of an enclosed curtain of flexible material having along the upper edge a tubular portion and along the lower edge a flexible ballast, such as a chain, the curtain containing a plurality of spaced-apart short length cylindrical floats in the upper tubular edge, each float having a passageway therethrough permitting the flow of air through the float and to all parts of the interior of the upper tubular edge so that the boom when placed on the water will float and, when removed from water and collapsed into stored position will permit air to escape, the opening being closeable while the boom is in use on water.

U.S. Pat. No. 4,846,423, Gliding Wing Parachute Apparatus with Staged Reefing Deployment Means, issued to James D. Reuter on Nov. 23, 1987, teaches a gliding wing parachute apparatus which has a plurality of longitudinally extending ram-air inflation cells which are grouped into individual stages which are released preferably upon full inflation of the previous stage. The stages are preferably balanced with respect to the centerline of the parachute. The second and third stages are reefed by being retained by lacing or fabric flaps into closed position until full deployment of the previously deployed stage is completed. Pyrotechnic cutting devices can be responsive to full inflation to cause release of the next scheduled stage of ram-air inflation cells. Subsequent stages can be formed by inflation cells of a thinner material since the load will be less than during initial deployment. Also tensile strength of suspension lines can be decreased with subsequent stages due to lower loading characteristics.

U.S. Pat. No. 4,884,769, entitled Aerial Recovery Parachute System, issued to Edwin Snead on Dec. 5, 1989, teaches a mid-air aerial recovery system which includes a payload, a parachute, and an aerial engagement apparatus. The parachute is connected to the payload. The parachute has a sufficient size to support the weight of the payload. The parachute has a plurality of suspension lines extending from the payload to a canopy of the parachute. The aerial engagement apparatus is a loop rope fastened to the parachute and extending outwardly beyond the canopy of the parachute. This loop rope forms a reception area. The parachute is a ram-air parachute. The loop rope is fastened at one end to the payload and extends along the suspension lines of the parachute and is attached to a leading edge of the canopy.

U.S. Pat. No. 4,928,909, entitled Elliptical Ram Air Pressurized Airfoil Parachute, issued to John G. Bouchard on May 29, 1990, teaches an improved parachute which utilizes a ram air design and has an upper surface connected to a lower surface by a plurality of rib members and forming a plurality of chambers therebetween. The end chambers are smaller than the center chambers and this increases the lift-to-drag ratio of the parachute. The parachute has a substantially elliptical planform so as to increase the aspect and glide ratios of the parachute.

U.S. Pat. No. 4,930,728, entitled Ram Air Aerial Device with Lower Skin Pressure Regulator, issued to George R. Wittington on June 5, 1990, teaches a ram air type parachute cell has a leading edge, a trailing edge, two side ribs, a flexible upper skin, and a flexible lower skin. A central rib is disposed substantially centrally between the first and second ribs to divide the cell into a plurality of compartments. The lower sheet includes a first forward skin and a second rearward skin. The rear portion of the first forward skin and the front portion of the second rearward skin form a closable air inlet vent opening into the cell. Each side of the rear portion of the first forward skin is connected at a connection point to the respective rib at a point spaced above the junction of the second rearward skin and the rib. When air pressure inside the cell exceeds the air pressure outside the cell, the rear portion of the first forward skin is forced onto the front portion of the second rearward skin to close the air inlet vent by lying substantially flat on the front portion of the second rearward skin without billowing out of the cell to maintain air pressure inside said cell. When the air pressure outside the cell exceeds the air pressure inside the cell, the rear portion of the first forward skin is forced upwardly away from the front portion of the second rearward skin to open the air inlet vent.

SUMMARY OF THE INVENTION

In view of the foregoing factors and conditions which are characteristic of the prior art it is the primary object of the present invention to provide a ram-air inflatable beam for use with a spinnaker which holds the spinnaker open and increases the forward vector by twenty to forty percent depending on the point of sail.

It is another object of the present invention to provide a ram-air inflatable beam for use with a spinnaker which allows the spinnaker to resist either wrapping or collapsing.

It is still another object of the present invention to provide a ram-air inflatable beam for use with a spinnaker which allows the spinnaker to be easily flown either with or without a spinnaker pole.

It is yet another object of the present invention to provide a ram-air inflatable beam for use with a spinnaker which allows the sail boat to increase its pointing capability by a minimum of ten degrees.

In accordance with the present invention an embodiment of a ram-air inflatable beam for use with a spinnaker, a large, substantially triangular sheet of flexible material with a front face and two side peripheral edges, is attached to a mast of a sail boat is described. The ram-air inflatable beam includes a tube, an air inlet and a valve. The tube is formed by a rectangular sheet of flexible material which has a first end edge, a second end edge and two side edges. The two side edges are disposed perpendicular to the mast and are mechanically coupled to the front face of the spinnaker extending from one side peripheral edge to the other side peripheral edge thereof to form a first open end and a second open end. The air inlet includes a stiffening member and an extended scoop which are mechanically coupled to the tube at the first open end and lets air into the tube. The valve includes a loose flap of cloth and an anchor. The loose flap of cloth has a first end, which is attached to the interior of the tube at the second open end, and a second end, which the anchor mechanically couples to the spinnaker so that a section of the loose flap of cloth closes off the second open end of the tube in order to trap air therein.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 8 is a schematic drawing of a sail boat, when viewed from the top, showing that a spinnaker with a ram-air inflatable beam of the present invention has a greater resultant forward vector force than does the sail boat of FIG. 9 when the wind is abeam.

FIG. 9 is a schematic drawing of a sail boat, when viewed from the top, showing that a spinnaker without a ram-air inflatable beam has a smaller resultant forward vector force than does the sail boat of FIG. 8 when the wind is abeam.

FIG. 10 is a schematic drawing of a sail boat, when viewed from the top, showing that, when the wind is aft, a spinnaker without a ram-air inflatable beam has a smaller resultant forward vector force than does a spinnaker with a ram-air inflatable beam of the present invention because the ram-air inflatable beam holds the spinnaker more open.

FIG. 11 is a perspective view of a sail boat which is flying a spinnaker without a spinnaker pole having the first ram-air inflatable beam of FIG. 1.

DESCRIPTION OF THE PREFERRED EMBODIMENT

Figure 1:
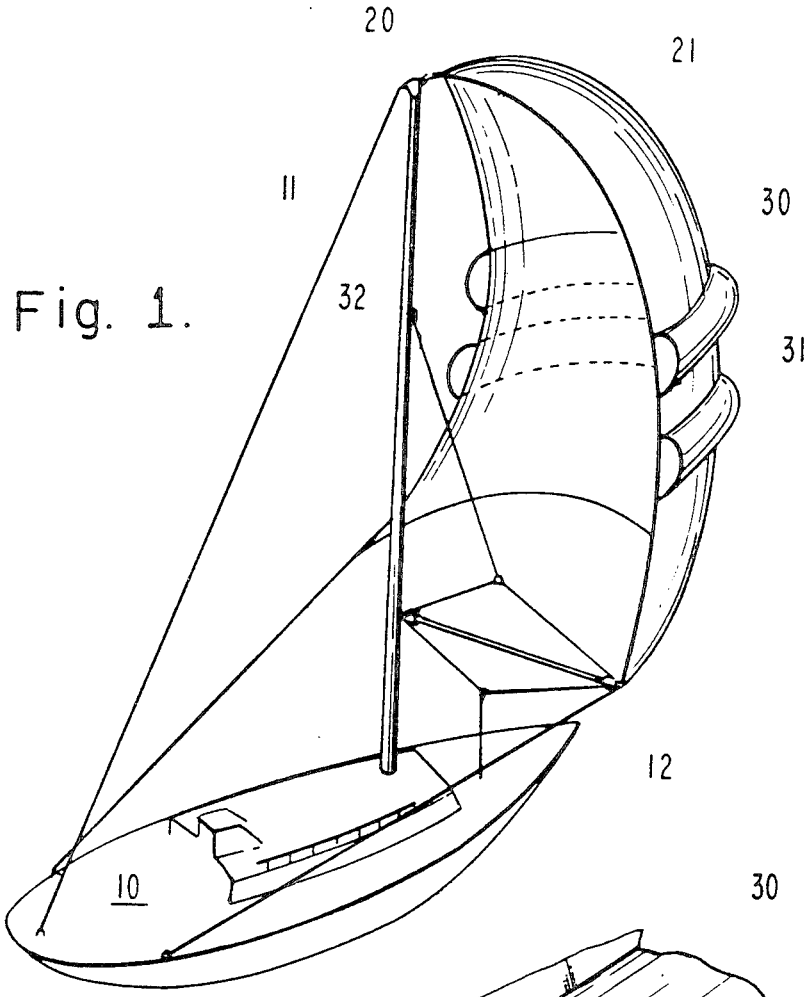
FIG. 1 is a perspective view of a sail boat which is flying a spinnaker having a spinnaker pole and a first ram-air inflatable beam which includes a tube, air inlet and a valve and which has been made in accordance with the principles of the first embodiment of the present invention.

In order to best understand the present invention it is necessary to refer to the following description of its preferred embodiment in conjunction with the accompanying drawing. Referring to FIG. 1 in conjunction with FIG. 2 a sail boat 10 which has a mast 11 and a spinnaker pole 12. The sail boat 10 is flying a spinnaker 20 which is a large, substantially triangular sheet of flexible material with a front face 21 and two side peripheral edges 22 and which is attached to the mast 11. A first ram-air inflatable beam 30 includes a tube 31, a first air inlet 32 and a valve 33.

Figure 2:
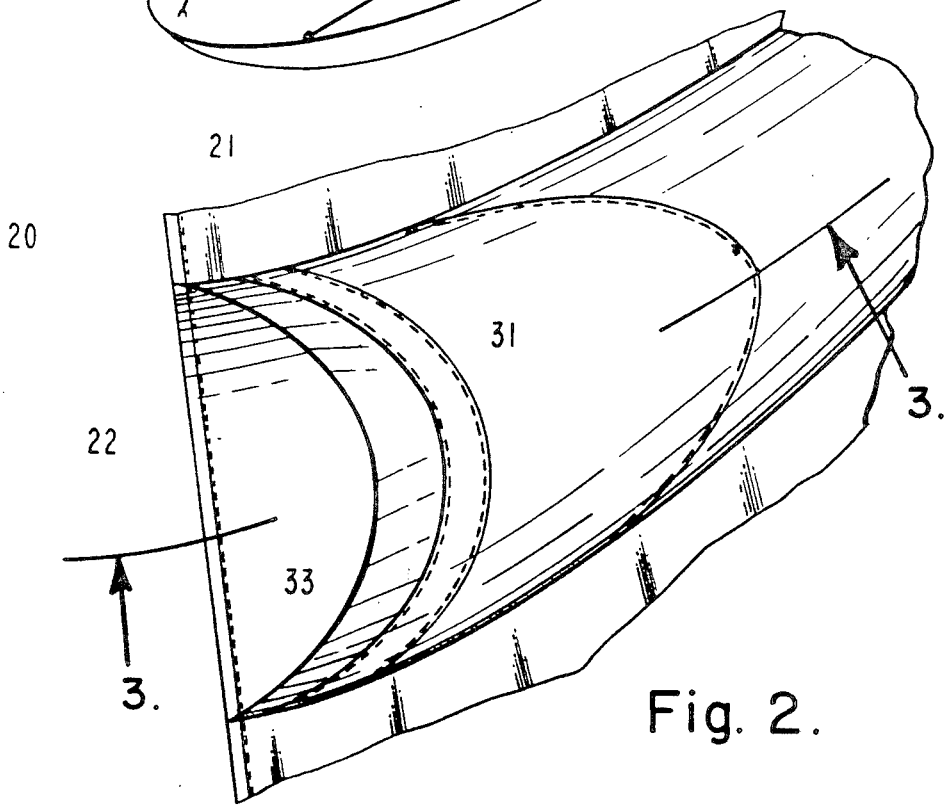
FIG. 2 is an enlarged, partial perspective view of the spinnaker and the ram-air inflatable beam of FIG. 1.
Figure 4:
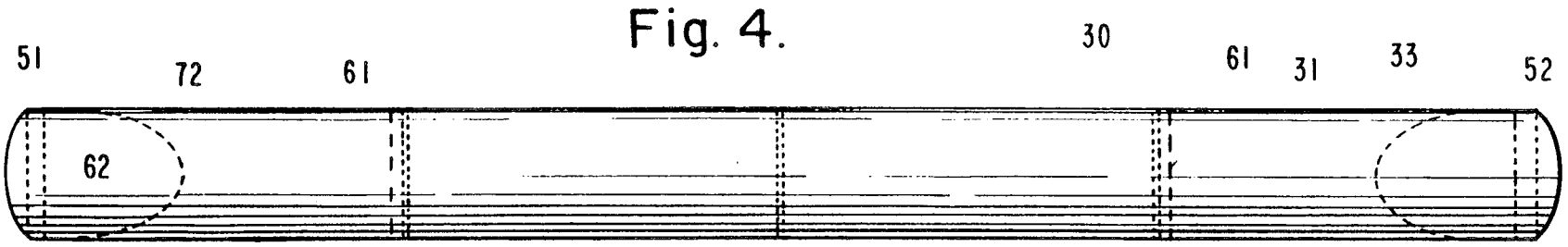
FIG. 4 is a top plan view of the first ram-air inflatable beam of FIG. 1 the air inlet of which includes a stiffening member and an extended scoop at the open end thereof.
Figure 3:
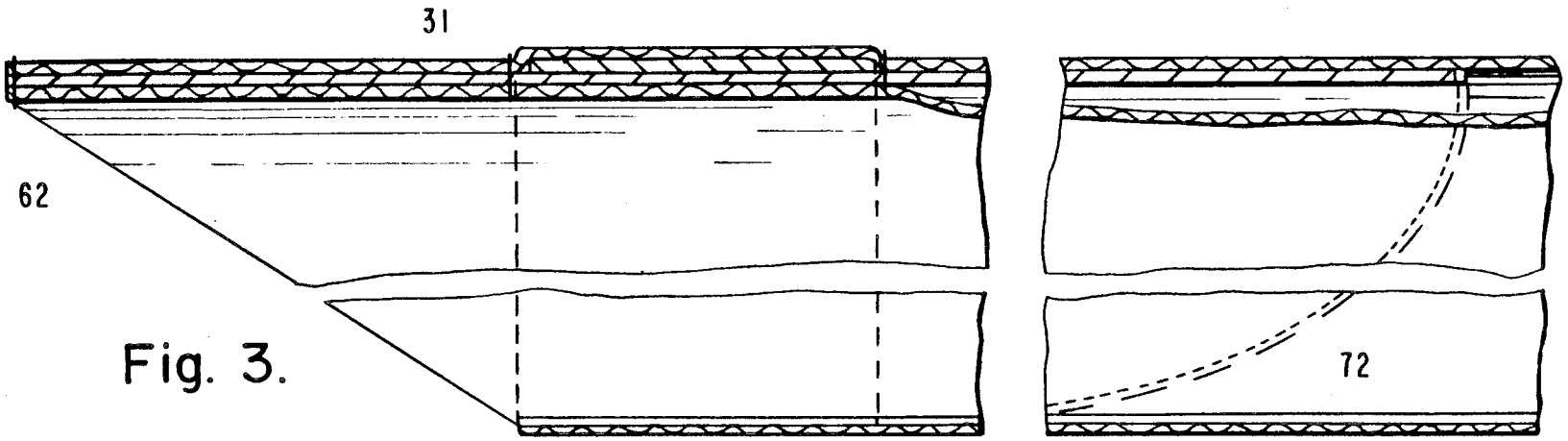
FIG. 3 is an enlarged, partial cross-sectional view of the spinnaker and the first ram-air inflatable beam of FIG. 1 taken along line 3—3 of FIG. 2.

Referring to FIG. 2 in conjunction with FIG. 3 and FIG. 4 the tube 31 is formed by a rectangular sheet 40 of flexible material which has a first end edge 41, a second end edge 42 and two side edges 43. The two side edges 43 are disposed perpendicular to the mast 11 and are mechanically coupled to the front face 21 of the spinnaker 20 extending from one side peripheral edge 22 to the other side peripheral edge 22 thereof to form a first open end 51 and a second open end 52. The first air inlet 32 includes a stiffening member 61 and an extended scoop 62 which are mechanically coupled to the tube 31 at the first open end 51 and lets air into the tube 31.

Figure 5:
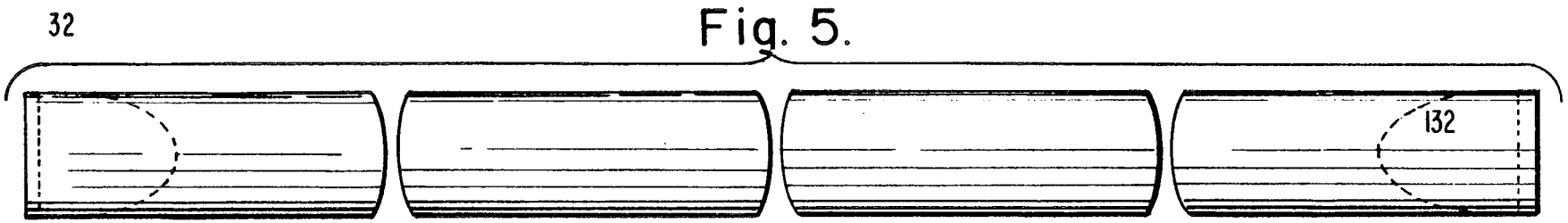
FIG. 5 is a top plan view of a unsewn second ram-air inflatable beam which includes a tube, an air inlet and a valve with the air inlet not including either a stiffening member or an extended scoop at the open end thereof and which has been made in accordance with the principles of the second embodiment of the present invention.

Referring to FIG. 5 a second ram-air inflatable beam 130 includes a tube 31, a second air inlet 132 and a valve 33. The second air inlet 32 does includes either a stiffening member or an extended scoop.

Figure 6:
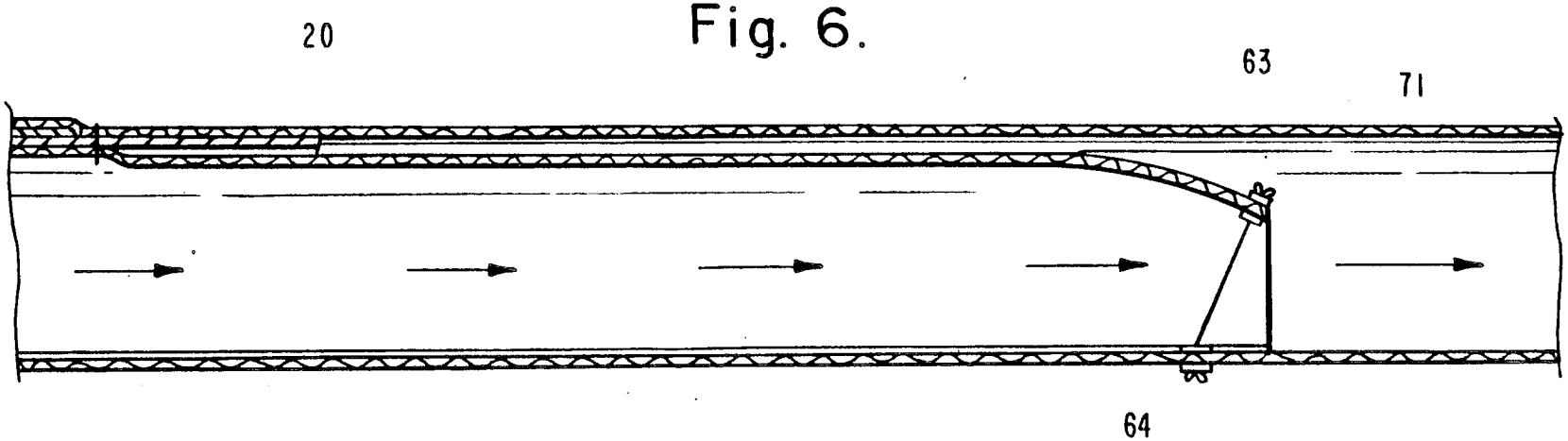
FIG. 6 is a cross-sectional view of the spinnaker and the first ram-air inflatable beam of FIG. 1 taken along line 3—3 of FIG. 2 showing that when the valve is open air flow through the air inlet into the tube.
Figure 7:
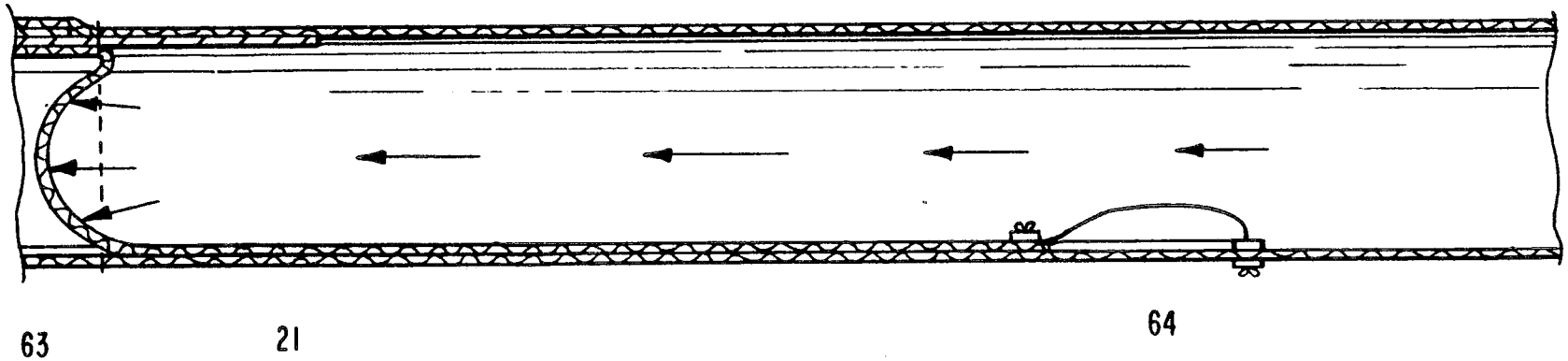
FIG. 7 is a cross-sectional view of the spinnaker and the first ram-air inflatable beam of FIG. 1 taken along line 3—3 of FIG. 2 showing that when the valve is closed air is trapped within the tube.

Referring to FIG. 6 in conjunction with FIG. 3 and FIG. 7 the valve 33 includes a loose flap 63 of cloth and an anchor 64. The loose flap 63 of cloth has a first end 65, which is attached to the interior of the tube 31 at the second open end 52, and a second end 66, which the anchor mechanically couples to the spinnaker 20 so that a section of the loose flap 63 of cloth closes off the second open end 52 of the tube 31 in order to trap air therein.

Referring to FIG. 2 in conjunction with FIG. 3, FIG. 4, FIG. 6 amd FIG. 7 the first ram-air inflatable beam 30 also includes a second air inlet 71 at the second open end 52 and a second valve 72 which closes off the first open end 51. The direction of the wind through the tube 31 determines whether the first valve 33 or the second valve 72 is open or closed.

Referring to FIG. 8 in conjunction with FIG. 9 a spinnaker with a ram-air inflatable beam of the present invention has a greater resultant forward vector force than does a spinnaker without a ram-air inflatable beam when the wind is abeam. The ram-air inflatable beam holds the spinnaker open and increases the forward vector by twenty to forty percent depending on the point of sail. The ram-air inflatable beam allows the spinnaker to resist either wrapping or collapsing. The ram-air inflatable beam for use with a spinnaker which allows the sail boat to increase its pointing capability by a minimum of ten degrees.

Referring to FIG. 10 a spinnaker with a ram-air inflatable beam of the present invention has a greater resultant forward vector force than does a spinnaker without a ram-air inflatable beam when the wind is aft because the ram-air inflatable beam holds the spinnaker more open. The ram-air inflatable beam holds the spinnaker open and increases the forward vector by twenty to forty percent depending on the point of sail. The ram-air inflatable beam allows the spinnaker to resist either wrapping or collapsing.

Referring to FIG. 11 a sail boat using the first ram-air inflatable beam 30 may fly a spinnaker without using a spinnaker pole. The ram-air inflatable beam allows the spinnaker to be easily flown either with or without a spinnaker pole.

From the foregoing it can be seen that a ram-air inflatable beam for use with a spinnaker has been described.

It should be noted that the sketches are not drawn to scale and that distance of and between the figures are not to be considered significant.

What is claimed is:

1. A ram-air inflatable beam for use with a spinnaker which is formed out of a large, substantially triangular sheet of flexible material with a front face and two side peripheral edges and which is attached to a mast of a sail boat, said ram-air inflatable beam comprising:

a. a tube which is formed by a rectangular sheet of flexible material having a first end edge, a second end edge and two side edges, said two side edges being disposed perpendicular to the mast and mechanically coupled to the front face of the spinnaker extending from one side peripheral edge to the other side peripheral edge thereof to form a first open end and a second open end;

b. inletting means for letting air into said tube at said first open end and including a stiffening member which is mechanically coupled to said tube at said first open end and which let air into said tube at said first open end; and c. valving means for closing off said second open end of said tube to trap air therein, said valving means being mechanically coupled to said tube at said second open end thereof.

2. A ram-air inflatable beam for use with a spinnaker according to claim 1 wherein said inletting means also comprises an extended scoop which is mechanically coupled to said tube at said first open end.

3. A ram-air inflatable beam for use with a spinnaker according to claim 1 wherein said valving means comprises a. a loose flap of cloth having a first end and a second end, said first end of said loose flap of cloth being attached to the interior of said tube at said second open end; and b. anchoring means for anchoring said loose flap of cloth at said second end thereof, said anchoring means being mechanically coupled to said second end of said loose flap of cloth so that a section of said loose flap of cloth closes said second open end of said tube.

4. A ram-air inflatable beam for use with a spinnaker which is formed out of a large, substantially triangular sheet of flexible material with a front face and two side peripheral edges and which is attached to a mast of a sail boat, said ram-air inflatable beam comprising:

a. a tube which is formed by a rectangular sheet of flexible material having a first end edge, a second end edge and two side edges, said two side edges being disposed perpendicular to the mast and mechanically coupled to the front face of the spinnaker extending from one side peripheral edge to the other side peripheral edge thereof to form a first open end and a second open end;

b. a first stiffening member which is mechanically coupled to said tube at said first open end and which let air into said tube at said first open end;

c. a second stiffening member which is mechanically coupled to said tube at said second open end and which let air into said tube at said second open end;

d. first valving means for closing off said second open end of said tube to trap air therein, said first valving means being mechanically coupled to said tube at said second open end thereof; and e. second valving means for closing off said first open end of said tube to trap air therein, said second valving means being mechanically coupled to said tube at said first open end thereof whereby the direction of the wind through said tube determine whether said first valving means or said second valving means is open or closed.

5. A ram-air inflatable beam for use with a spinnaker according to claim 4 wherein said ram-air inflatable beam also comprises:

a. a first extended scoop which is mechanically coupled to said tube at said first open end; and b. a second extended scoop which is mechanically coupled to said tube at said second open end.

6. A ram-air inflatable beam for use with a spinnaker according to claim 4 wherein said first valving means comprises a. a first loose flap of cloth having a first end and a second end, said first end of said first loose flap of cloth being attached to the interior of said tube at said second open end; and b. first anchoring means for anchoring said first loose flap of cloth at said second end thereof, said first anchoring means being mechanically coupled to said second end of said first loose flap of cloth so that a section of said first loose flap of cloth closes said second open end of said tube.

7. A ram-air inflatable beam for use with a spinnaker according to claim 6 wherein said second valving means comprises a. a second loose flap of cloth having a first end and a second end, said first end of said second loose flap of cloth being attached to the interior of said tube at said first open end; and b. second anchoring means for anchoring said second loose flap of cloth at said first end thereof, said second anchoring means being mechanically coupled to said second end of said second loose flap of cloth so that a section of said second loose flap of cloth closes said first open end of said tube.

* * * * *